US007658378B2

(12) United States Patent
Lappok et al.

(10) Patent No.: US 7,658,378 B2
(45) Date of Patent: Feb. 9, 2010

(54) APPARATUS AND METHOD FOR ALIGNING SHEET STACKS AND SHEET PROCESSING MACHINE HAVING THE APPARATUS

(75) Inventors: Reinhard Lappok, Dormagen (DE); Andre Pütz, Erkelenz (DE); Guido Zanders, Mönchengladbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 81 days.

(21) Appl. No.: 12/014,289

(22) Filed: Jan. 15, 2008

(65) Prior Publication Data

US 2008/0169597 A1 Jul. 17, 2008

(30) Foreign Application Priority Data

Jan. 15, 2007 (DE) ..... 10 2007 002 154

(51) Int. Cl.
*B65H 9/12* (2006.01)
*B65H 31/36* (2006.01)

(52) U.S. Cl. ..... 271/241; 271/221; 414/789.1

(58) Field of Classification Search ..... 271/241, 271/221; 414/795.7, 788.9, 789.1
See application file for complete search history.

(56) References Cited

U.S. PATENT DOCUMENTS

| | | | | |
|---|---|---|---|---|
| 3,982,751 | A * | 9/1976 | Obenshain | 271/221 |
| 4,147,342 | A * | 4/1979 | Naramore | 271/221 |
| 4,346,882 | A * | 8/1982 | Pessina et al. | 271/221 |
| 4,607,831 | A * | 8/1986 | Raybuck | 271/240 |
| 4,971,311 | A | 11/1990 | Tsukimoto | |
| 5,116,041 | A | 5/1992 | Pollich | |
| 5,338,020 | A | 8/1994 | Eltner et al. | |
| 5,423,656 | A | 6/1995 | Filsinger et al. | |
| 5,890,713 | A | 4/1999 | Hofmann et al. | |
| 6,168,154 | B1 | 1/2001 | Asahara et al. | |

FOREIGN PATENT DOCUMENTS

| | | |
|---|---|---|
| DE | 25 25 649 B1 | 9/1976 |
| DE | 2939267 A1 | 4/1981 |
| DE | 3710329 A1 | 1/1988 |
| DE | 39 41 993 C1 | 1/1991 |
| DE | 41 29 136 C2 | 3/1993 |
| DE | 42 20 074 A1 | 12/1993 |
| DE | 44 26 861 C2 | 2/1996 |
| DE | 196 27 241 C2 | 6/1997 |
| DE | 198 52 365 C2 | 5/2000 |
| EP | 0505021 A2 | 9/1992 |
| EP | 0970903 A2 | 1/2000 |
| GB | 1 511 088 | 5/1978 |

OTHER PUBLICATIONS

European Search Report dated Oct. 15, 2009.

* cited by examiner

*Primary Examiner*—David H Bollinger
(74) *Attorney, Agent, or Firm*—Laurence A. Greenberg; Werner H. Stemer; Ralph E. Locher

(57) ABSTRACT

An apparatus for aligning sheet stacks in a feeder of sheet processing machines includes a motor-driven aligning plate and a movement converter situated between a motor drive and the aligning plate. The movement converter forces a movement describing approximately a circular path onto the aligning plate. A vertical speed component of the aligning plate during aligning corresponds to an upward speed of a feeder stack. A method for aligning sheet stacks in a feeder of a sheet processing machine as well as a sheet processing machine, are also provided.

16 Claims, 5 Drawing Sheets

APPARATUS AND METHOD FOR ALIGNING SHEET STACKS AND SHEET PROCESSING MACHINE HAVING THE APPARATUS

CROSS-REFERENCE TO RELATED APPLICATION

This application claims the priority, under 35 U.S.C. § 119, of German Patent Application DE 10 2007 002 154.4, filed Jan. 15, 2007; the prior application is herewith incorporated by reference in its entirety.

BACKGROUND OF THE INVENTION

Field of the Invention

The invention relates to an apparatus for aligning sheet stacks in a feeder of sheet processing machines, in particular printing presses or machines for further print processing, having an aligning plate which is driven by motor. The invention also relates to a method for aligning sheet stacks in the feeder of a sheet processing machine having the apparatus for aligning sheet stacks. The invention additionally relates to a sheet processing machine having the apparatus.

Different types of apparatuses are known for an exact stack formation of sheets to be deposited in a delivery of a sheet processing machine. German Patent DE 196 27 241 C2, corresponding to U.S. Pat. No. 5,890,713, describes an apparatus for forming a sheet stack in the delivery of a sheet-fed printing press. The alignment takes place with the aid of vibratory plates which are connected to vibration exciters. In that case, the vibration exciters vibrate independently of a delivery cycle.

German Published, Non-Prosecuted Patent Application DE 42 20 074 A1, corresponding to U.S. Pat. No. 5,423,656, discloses an apparatus for jogging a stack. In that case, a jogging rod which points in the direction of the stack and has a jogging plate at one end is used for jogging. A common feature of the two above-mentioned apparatuses is that the jogging or vibrating movement is purely translational.

An apparatus having an oscillating movement of an aligning plate is described in German Patent DE 198 52 365 C2. A side stop for aligning sheets on delivery stacks in deliveries of printing presses has an aligning plate. The aligning plate is mounted in a rotary bearing. The rotary bearing acts as a pivot point, about which the aligning plate is rotated by a small angle. At its maximum rotary angle, the aligning plate comes into contact with the delivery stack and aligns the latter as a result. Subsequently, the aligning plate is pivoted back into its original position again. In that case, the oscillation excitation of the aligning plate takes place through a pneumatic drive.

If nonstop feeders, such as, for example, those described in German Patent DE 41 29 136 C2, corresponding to U.S. Pat. No. 5,338,020, or German Patent DE 39 41 993 C1, corresponding to U.S. Pat. No. 5,116,041, are used in sheet processing machines, the sheet stacks also have to be aligned or jogged there. In order to make continuous machine operation possible, a residual stack which tends toward tilting is replaced by a new main stack in manual nonstop feeders. Since the residual stack and the main stack can be disposed offset with respect to one another, or individual sheets can be curved, oblique or offset with respect to their setpoint position, the sheets have to be aligned at their side edge and the sheet stack therefore has to be laterally aligned. That alignment takes place by hand according to the prior art.

Manual nonstop feeders have upwardly cycled stacks, that is to say the stack is moved upward, at the same cycle as sheets are pulled off and transferred to the sheet processing machine. As a result, the uppermost sheet of the sheet stack is always situated in the same position relative to the sheet removing apparatus, such as a suction head. Optimum separation and removal of the sheets can therefore be ensured.

A problem with manual stack alignment is that optimum stack alignment is not ensured but rather depends on how and if the machine operator aligns the feeder stack.

SUMMARY OF THE INVENTION

It is accordingly an object of the invention to provide an apparatus and a method for aligning sheet stacks and a sheet processing machine having the apparatus, which overcome the hereinafore-mentioned disadvantages of the heretofore-known devices and methods of this general type and which laterally align the sheet stack automatically in a feeder in the case of a continuous upward stack movement.

With the foregoing and other objects in view there is provided, in accordance with the invention, an apparatus for aligning sheet stacks in a feeder of a sheet processing machine, in particular a printing press or a machine for further print processing. The apparatus comprises a motor drive, an aligning plate driven by the motor drive, and a movement converter disposed between the motor drive and the aligning plate. The movement converter forces a movement describing an approximately circular path onto the aligning plate.

With the objects of the invention in view, there is also provided a method for aligning sheet stacks in a feeder of a sheet processing machine. The method comprises providing the apparatus for aligning sheet stacks according to the invention, and synchronizing a vertical speed component of the aligning plate during aligning to an upward speed of the feeder stack.

The apparatus according to the invention makes it possible to align sheet stacks in the feeder both in an exact manner, that is to say with precise edges, as well as in a gentle manner, that is to say without damaging the sheets.

The gentle alignment is achieved by the fact that the aligning plate of the apparatus describes approximately a circular path for aligning sheet stacks in the feeder of sheet processing machines. During the movement cycle, the aligning plate remains oriented parallel to the side face of the sheet stack of the feeder and the upper edge of the aligning plate remains oriented parallel to the upper edge of the sheet stack of the feeder. A movement converter is situated between a motor drive and the aligning plate. The movement converter converts the rotational movement which is provided at the motor drive and forces a movement which describes approximately a circular path onto the aligning plate.

In accordance with another feature of the invention, the movement converter has at least one toothed belt pulley, to which the rotational movement of the motor drive is transmitted through a toothed belt. If the movement converter has a plurality of toothed belt pulleys, the rotational movement of the motor drive can also be transmitted through either one circulating toothed belt or else through a plurality of toothed belts. The toothed belt pulleys are flange-connected in each case onto a rotatably mounted shaft. At its one end or at both ends, each shaft is connected fixedly to one lever at a first pivot point of the respective lever in each case. At a second pivot point of the respective lever, the aligning plate is mounted rotatably through the use of one pin in each case. In addition, the movement converter also has an element for guiding the aligning plate vertically.

In accordance with a further feature of the invention, the apparatus for aligning sheet stacks has a movement converter with two toothed belt pulleys. Two levers of the movement converter, which are spaced apart horizontally, are disposed exactly parallel to one another in this case, in order to make a synchronous rotational movement of the two levers possible and therefore an approximately circular movement of the aligning plate. The vertical guidance of the aligning plate is provided by its mounting at two pivot points of the levers.

In accordance with an added feature of the invention, the motor drive of the apparatus for aligning sheet stacks can, for example, be a servomotor or a frequency-controlled three-phase motor.

In accordance with an additional feature of the invention, advantageously, in each case one apparatus for aligning sheet stacks is fastened to both sides of the feeder, that is to say to the frame of the feeder on the left and right, as seen in the sheet transport direction. In this case, the apparatus for aligning sheet stacks is attached to the feeder frame in such a way that the aligning plate is situated at the level of the upper edge of the sheet stack of the feeder. This achieves a situation where the upper part of the sheet stack is aligned laterally and the sheets of the sheet processing machine can be fed with an accurate position. The apparatus according to the invention with the approximate circular movement of the aligning plate, in contrast to the mainly translational movement of the aligning plate in the prior art, prevents superposition of the upward movement of the feeder stack onto the laterally oriented jogging movement of the aligning plate. This is achieved by an advantageous method for aligning sheet stacks, in which the vertical speed component of the aligning plate during alignment corresponds to the upward speed of the feeder stack. The cyclical upward movement of the feeder stack and the approximately circular movement of the aligning plate are synchronized. The upward speed of the feeder stack depends firstly on the sheet thickness and secondly on the number of sheets which are transferred per unit time to the sheet processing machine, that is to say the machine speed.

In accordance with another mode of the method of the invention, the speed of the aligning plate can be regulated as a function of the machine speed. The adaptation of the speed of the aligning plate is advantageously performed automatically by a machine controller. In addition to the above-described vertical movement component, the movement of the aligning plate also has a horizontal movement component. This brings about a jogging movement of the aligning plate and therefore the alignment of the sheet stack.

In accordance with a further mode of the method of the invention, the alignment of the sheet stack takes place continuously. However, the motor drive of the apparatus can be stopped in every position, with the result that the aligning plate can also serve as a stationary side stop.

With the objects of the invention in view, there is concomitantly provided a sheet processing machine for processing sheets of paper, paperboard and the like. The sheet processing machine comprises an apparatus according to the invention for aligning sheet stacks.

Other features which are considered as characteristic for the invention are set forth in the appended claims.

Although the invention is illustrated and described herein as embodied in an apparatus and a method for aligning sheet stacks and a sheet processing machine having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
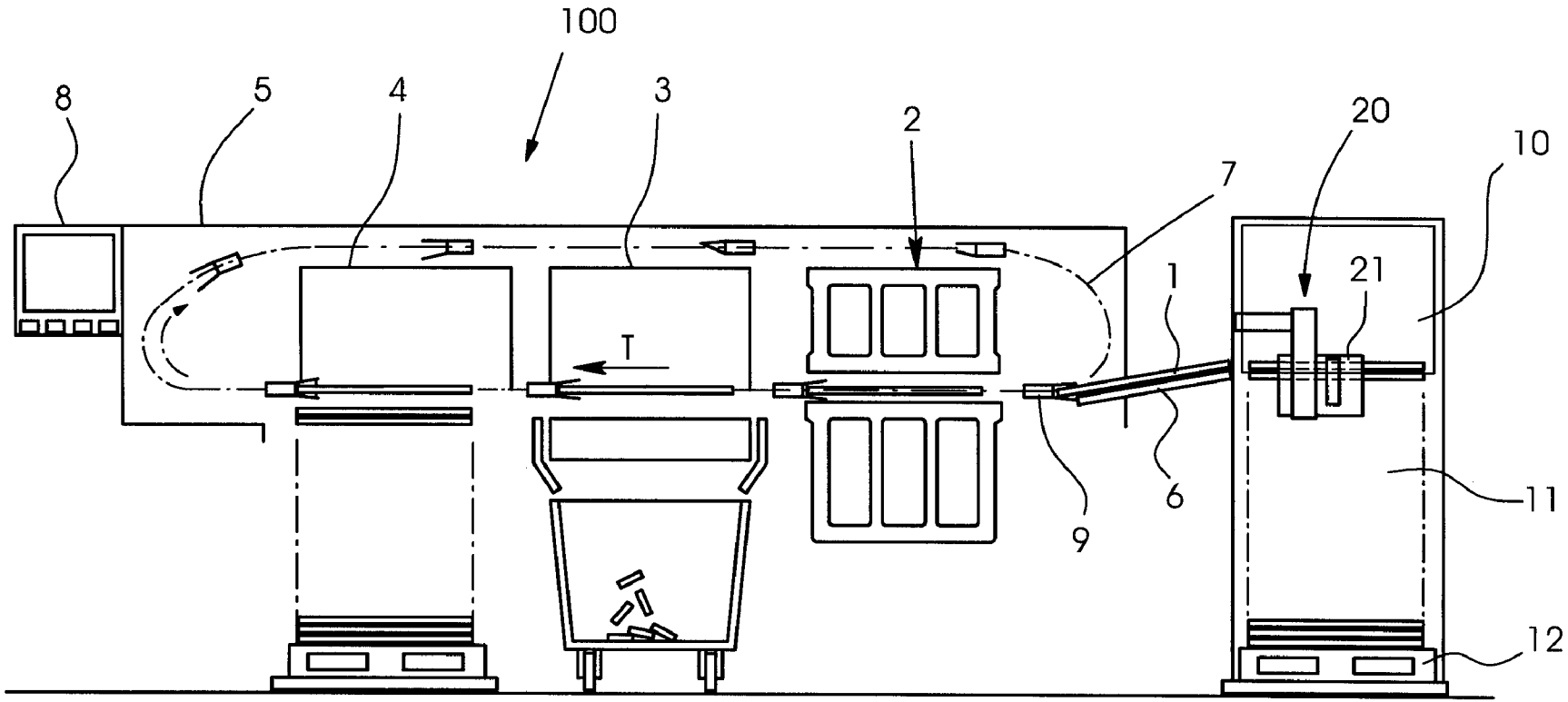
FIG. 1 is a diagrammatic, longitudinal-sectional view of a sheet punching and stamping machine having an apparatus according to the invention for aligning sheet stacks.

Referring now to the figures of the drawings in detail and first, particularly, to FIG. 1 thereof, there is seen a principal construction of a sheet punching and stamping machine 100 for punching, stripping and depositing sheets 1 made from paper, paperboard and the like. The punching and stamping machine 100 has a feeder 10, a punching station 2, a stripping station 3 and a delivery 4, which are carried and enclosed by a common machine housing 5.

The feeder 10 is a manual nonstop feeder which is provided with a device (not shown in FIG. 1) for introducing a new main stack. The figure shows a feeder stack 11 which is situated on a pallet 12. The feeder 10 has a device (not shown in FIG. 1) for moving the feeder stack 11 upward in a synchronized manner. An apparatus 20, which has an aligning plate 21 for laterally aligning the sheets 1 of the feeder stack 11, is fastened to a frame of the feeder 10.

The sheets 1 are separated from the feeder stack 11 by the feeder 10, are fed over a feed table 6 to the sheet punching and stamping machine 100 and are pulled in a sheet transport direction T through the various stations 2, 3 and 4 of the punching and stamping machine 100 by a transport system 7 having gripper carriages 9.

The punching station 2 includes a lower table and an upper table. The lower table is mounted fixedly in the machine frame and is provided with a backing plate for a punching knife. The upper table is mounted in such a way that it can move back and forth vertically.

The gripper carriages 9 transport the sheet 1 from the punching and stamping station 2 into the following stripping station 3, which is equipped with stripping tools. In the stripping station 3, waste pieces which are not required are ejected downward from the sheet 1 with the aid of the stripping tools, as a result of which the waste pieces fall into a container-like carriage that is pushed-in below the station.

The sheet 1 passes from the stripping station 3 into the delivery 4, where the sheet 1 is either only simply deposited or else a separation of individual multiple copies takes place at the same time. The delivery 4 can also include a pallet, on which the individual sheets are stacked in the form of a stack, so that after a defined stack height is reached, the pallets with the stacked sheets 1 can be moved away out of the region of the punching and stamping machine 100.

Figure 2:
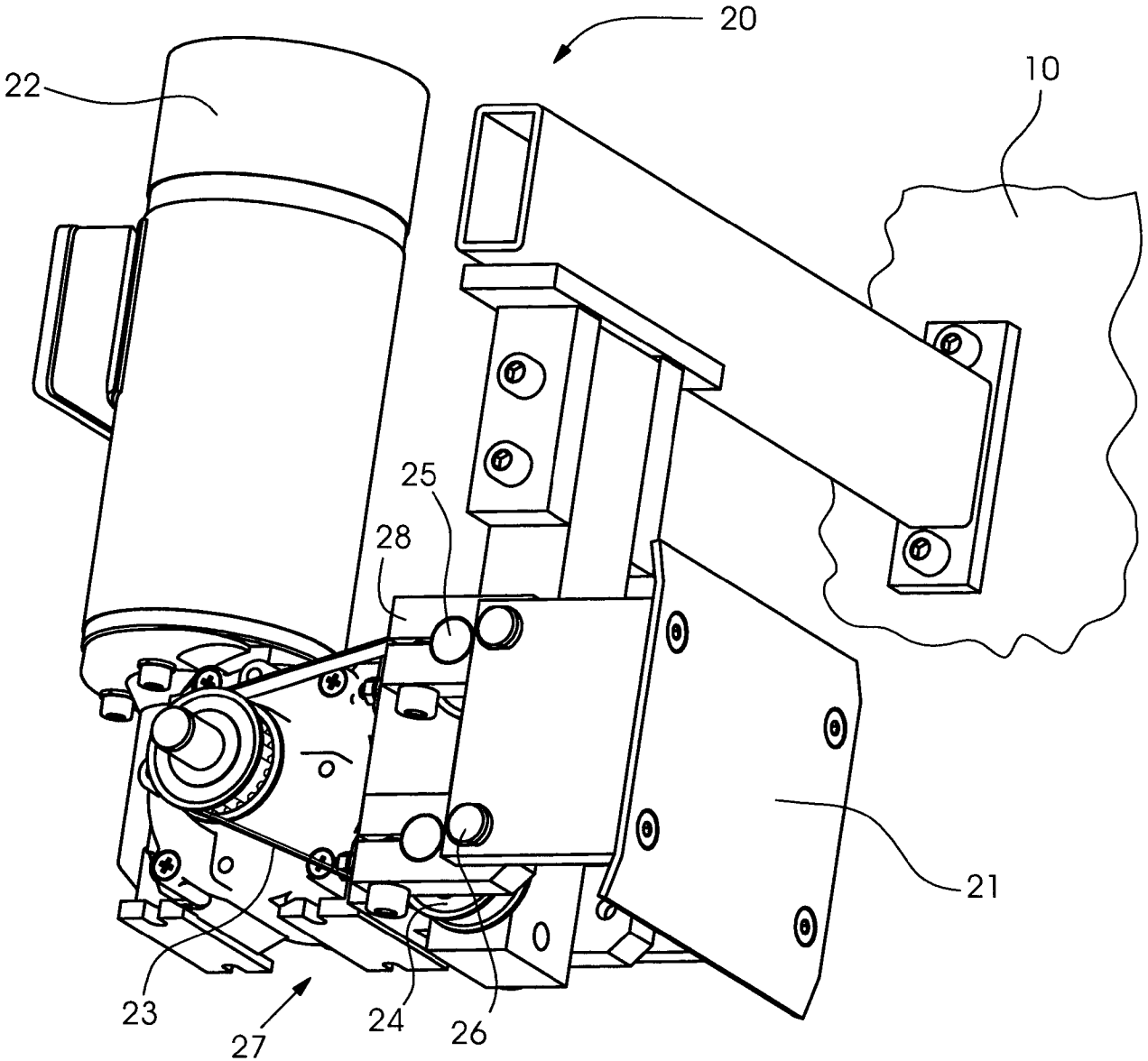
FIG. 2 is an enlarged, perspective view of the apparatus for aligning sheets.

FIG. 2 shows the apparatus 20 according to the invention for aligning sheets. The apparatus 20 is fastened to the feeder 10. The apparatus 20 for aligning sheets includes a motor drive 22, the aligning plate 21 and a movement converter 27 which is disposed therebetween. The movement converter 27 converts a rotational movement of the motor drive 22 and forces or impinges an approximately circular movement onto the aligning plate 21. The rotational movement of the motor drive 22 is transferred through a toothed belt 23 to two toothed belt pulleys 24. The toothed belt pulleys 24 are each flange-connected to a respective shaft 25. A lever 28 is fastened to the end of each respective shaft 25. The aligning plate 21 is connected to the levers 28 through the use of pins 26.

Figure 3:
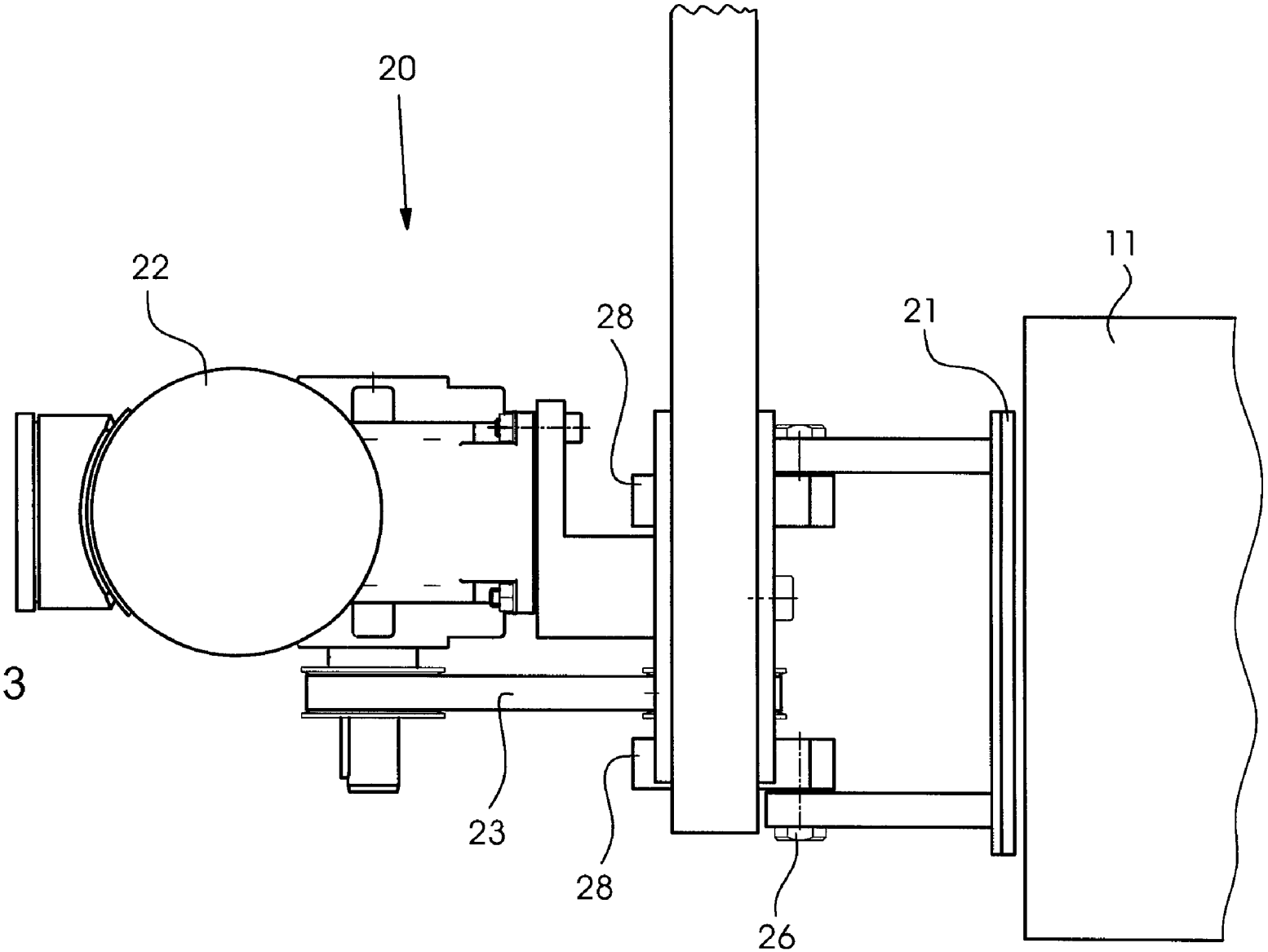
FIG. 3 is a fragmentary, top-plan view of the apparatus for aligning sheets.
Figure 4:
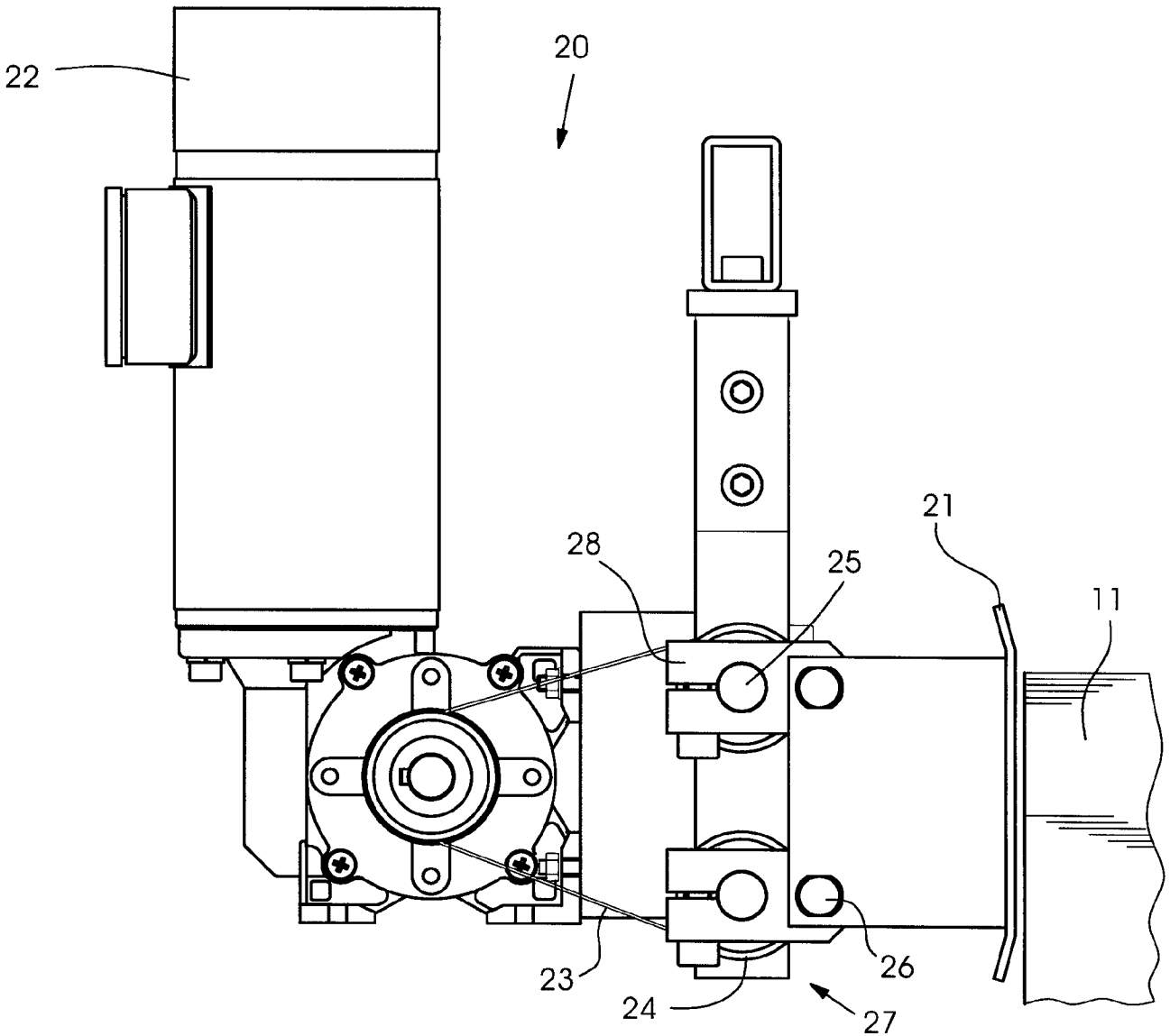
FIG. 4 is a fragmentary, side-elevational view of the apparatus for aligning sheets.

It is clear from FIG. 3 that the levers 28 are mounted fixedly at both ends of each shaft 25 (not denoted in FIG. 3). The aligning plate 21 is therefore fastened to one of four levers 28 through the use of one pin 26 in each case. It is seen from FIGS. 3 and 4 that the aligning plate 21 is oriented parallel to the side face of the feeder sheet stack 11. Furthermore, FIG. 4 shows that the levers 28, which are spaced apart vertically, are oriented in each case exactly parallel to one another.

Figure 5:
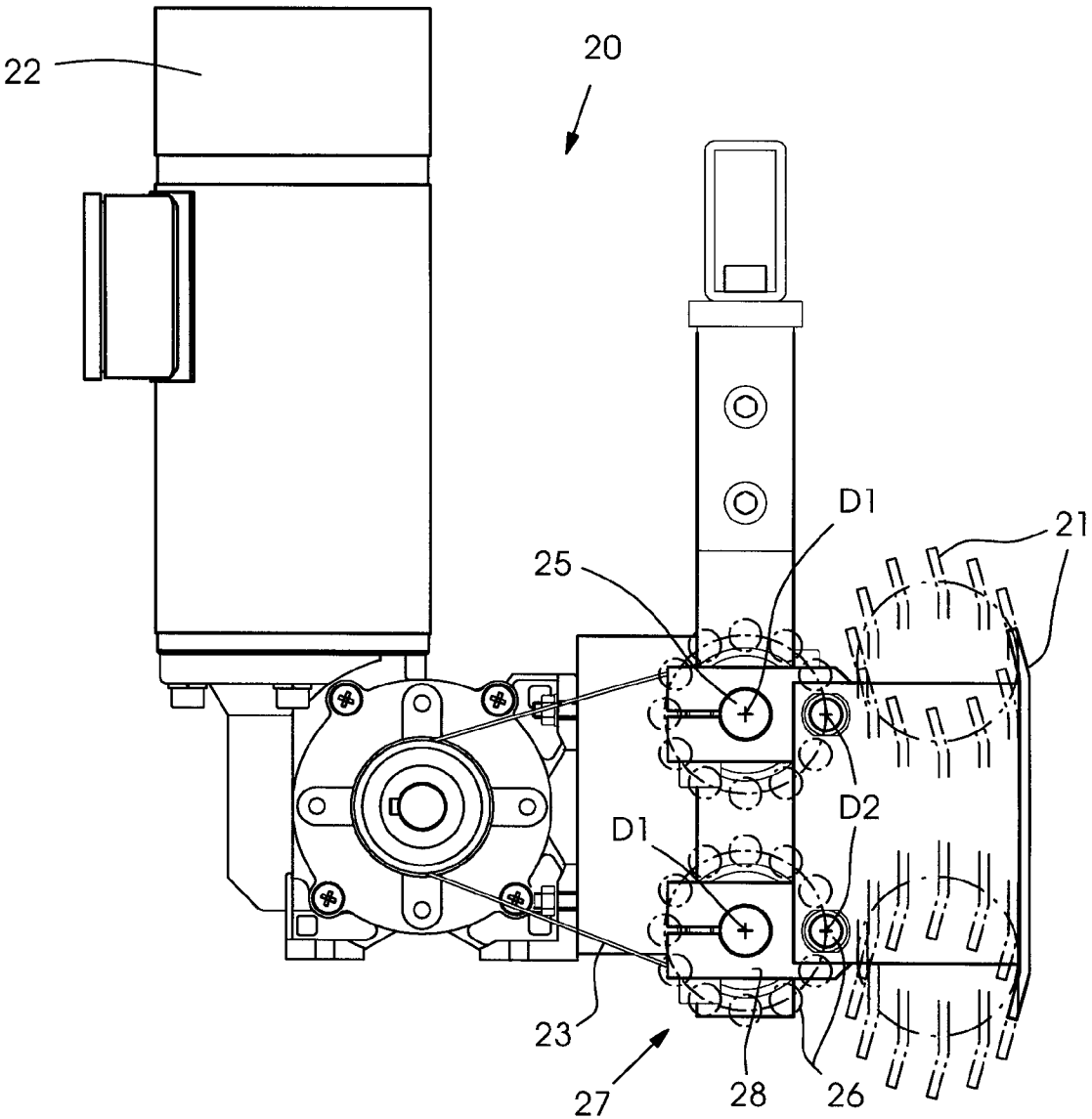
FIG. 5 is a side-elevational view of the apparatus for aligning sheets, illustrating positions of an aligning plate within one movement cycle.

FIG. 5 shows the movement sequence of the aligning plate 21 within one movement cycle. In this case, various positions of the aligning plate 21 and of the two visible pins 26 are indicated by dash-dotted lines. The circular path, along which a pin 26 moves, and the circular path, along which the aligning plate 21 moves, are likewise indicated. The method of operation of the movement converter 27 emerges unambiguously from this illustration: the two toothed belt pulleys 24 (not shown in FIG. 5) are set into a rotational movement by the toothed belt 23. The toothed belt pulleys 24 are flange-connected fixedly to the shafts 25. The levers 28 are mounted fixedly in terms of rotation on the shafts 25. A common pivot point of the shaft 25, the toothed belt pulley 24 and the lever 28 is a first pivot point D1. The aligning plate 21 is connected to the levers 28 by the pins 26 and is mounted rotatably in the pins 26 at a second pivot point D2. The first pivot point D1 and the second pivot point D2 are spaced apart from one another. The magnitude of the spacing determines the circular path movement which is forced onto the aligning plate 21.

The invention claimed is:

1. An apparatus for aligning sheet stacks in a feeder of a sheet processing machine, the apparatus comprising:

a motor drive;

an aligning plate driven by said motor drive; and a movement converter disposed between said motor drive and said aligning plate, said movement converter forcing a movement describing an approximately circular path onto said aligning plate, said movement converter including:

at least one toothed belt driven by said motor drive;

at least one toothed belt pulley to which a rotational movement of said motor drive is transmitted by said at least one toothed belt;

at least one rotatably mounted shaft onto which said at least one toothed belt pulley is flange-connected;

at least one lever to which said at least one rotatably mounted shaft is connected fixedly in terms of rotation at least at one end at a first pivot point;

at least one pin rotatably mounting said aligning plate at a second pivot point of said at least one lever; and an element for guiding said aligning plate vertically.

2. The apparatus for aligning sheet stacks according to claim 1, wherein said aligning plate is disposed at a level of an upper edge of the sheet stack in the feeder.

3. The apparatus for aligning sheet stacks according to claim 1, wherein the apparatus is fastened to a frame of the feeder.

4. The apparatus for aligning sheet stacks according to claim 1, wherein said motor drive is a servomotor.

5. The apparatus for aligning sheet stacks according to claim 1, wherein said motor drive is a frequency-controlled three-phase motor.

6. The apparatus for aligning sheet stacks according to claim 1, wherein the sheet processing machine is a printing press or a machine for further print processing.

7. A sheet processing machine for processing sheets of paper, paperboard and the like, the sheet processing machine comprising:

an apparatus according to claim 1 for aligning sheet stacks.

8. An apparatus for aligning sheet stacks in a feeder of a sheet processing machine, the apparatus comprising:

a motor drive;

an aligning plate driven by said motor drive; and a movement converter disposed between said motor drive and said aligning plate, said movement converter forcing a movement describing an approximately circular path onto said aligning plate, said movement converter including:

at least one toothed belt driven by said motor drive;

two toothed belt pulleys to which a rotational movement of said motor drive is transmitted by said at least one toothed belt;

rotatably mounted shafts onto each of which a respective one of said toothed belt pulleys is flange-connected;

levers to each of which a respective one of said rotatably mounted shafts is connected fixedly in terms of rotation at least at one end at a first pivot point; and pins each rotatably mounting said aligning plate at a second pivot point of a respective one of said levers.

9. The sheet processing machine according to claim 8 wherein the sheet processing machine is a sheet punching and stamping machine.

10. The apparatus for aligning sheet stacks according to claim 8, wherein said aligning plate is disposed at a level of an upper edge of the sheet stack in the feeder.

11. The apparatus for aligning sheet stacks according to claim 8, wherein the apparatus is fastened to a frame of the feeder.

12. The apparatus for aligning sheet stacks according to claim 8, wherein said motor drive is a servomotor.

13. The apparatus for aligning sheet stacks according to claim 8, wherein said motor drive is a frequency-controlled three-phase motor.

14. The apparatus for aligning sheet stacks according to claim 8, wherein the sheet processing machine is a printing press or a machine for further print processing.

15. A method for aligning sheet stacks in a feeder of a sheet processing machine, the method comprising the following steps:

providing an apparatus for aligning sheet stacks including a motor drive, an aligning plate driven by said motor drive, and a movement converter disposed between said motor drive and said aligning plate, said movement converter forcing a movement describing an approximately circular path onto said aligning plate;

synchronizing a vertical speed component of said aligning plate during aligning to an upward speed of the feeder stack; and regulating a speed of a movement of said aligning plate as a function of a machine speed.

16. A method for aligning sheet stacks in a feeder of a sheet processing machine, the method comprising the following steps:

providing an apparatus for aligning sheet stacks including a motor drive, an aligning plate driven by said motor drive, and a movement converter disposed between said motor drive and said aligning plate, said movement converter forcing a movement describing an approximately circular path having horizontal and vertical movement components onto said aligning plate; and synchronizing a vertical speed component of said aligning plate during aligning to an upward speed of the feeder stack.

* * * * *